US005589672A

United States Patent [19]

Uchida et al.

[11] Patent Number: 5,589,672

[45] Date of Patent: Dec. 31, 1996

[54] CIRCUIT BREAKER WITH ARC QUENCHING DEVICE AND VENT

[75] Inventors: Naoshi Uchida; Masao Miura; Jun Oyama; Katsunori Kuboyama; Koji Asakawa, all of Kawasaki, Japan

[73] Assignee: Fuji Electric Co., Ltd., Kawasaki, Japan

[21] Appl. No.: 477,822

[22] Filed: Jun. 7, 1995

[30] Foreign Application Priority Data

Jun. 14, 1994 [JP] Japan ..... 6-155332
Dec. 20, 1994 [JP] Japan ..... 6-334792

[51] Int. Cl.[6] ..... H01H 9/36; H01H 33/04

[52] U.S. Cl. ..... 218/34; 218/27; 218/35; 218/38; 218/151; 218/149; 218/157

[58] Field of Search ..... 218/15, 24, 27, 218/34–43, 90, 117, 146, 147, 149–151, 155–158; 335/201, 202

[56] References Cited

U.S. PATENT DOCUMENTS

| | | | |
|---|---|---|---|
| 3,440,378 | 4/1969 | Baird | 218/34 |
| 3,641,293 | 2/1972 | Armitage et al. | 218/151 |
| 4,451,718 | 5/1984 | Yamagata et al. | 218/27 |
| 4,631,376 | 12/1986 | Leone | 218/157 |
| 4,845,460 | 7/1989 | Manthe et al. | 218/90 |
| 4,935,589 | 6/1990 | Kohanawa | 218/152 |

FOREIGN PATENT DOCUMENTS

| | | | |
|---|---|---|---|
| 1053067 | 3/1959 | Germany | 218/158 |
| 56-497 | 1/1981 | Japan | H01H 9/36 |
| 62-180916 | 8/1987 | Japan | H01H 9/36 |
| 63-126136 | 5/1988 | Japan | H01H 73/18 |
| 63-126135 | 5/1988 | Japan | H01H 73/18 |
| 2-132716 | 5/1990 | Japan | H01H 9/36 |
| 3-102735 | 4/1991 | Japan | H01H 73/18 |

*Primary Examiner*—J. R. Scott
*Attorney, Agent, or Firm*—Kanesaka & Takeuchi

[57] ABSTRACT

A circuit breaker is formed of a stationary contact member bent back into a U-shape and having a stationary contact at a bent back portion thereof, a moving contact member situated adjacent to the stationary contact member to be able to contact with the stationary contact, a plurality of grids laminated vertically with a space therebetween, and a unitary molded insulator situated around the stationary contact member. The insulator includes a pair of side walls facing to each other, and a plurality of slots arranged in the opposed side walls to vertically space apart from each other. The grids are inserted into the slots to be vertically piled when the circuit breaker is assembled. The circuit breaker can be easily assembled.

11 Claims, 9 Drawing Sheets

CIRCUIT BREAKER WITH ARC QUENCHING DEVICE AND VENT

BACKGROUND OF THE INVENTION AND RELATED ART STATEMENT

The present invention relates to a circuit breaker, such as circuit breaker for wiring, earth leakage breaker, etc., and specifically relates to an arc quenching device for an electromagnetic repulsion type circuit breaker.

The so-called de-ion type arc quenching device shown in FIG. 19 has been well known as this sort of an arc quenching device for a circuit breaker. This arc quenching device has a structure such that grids 2 with V-shaped cutouts for passing a moving contact member 1 are piled up with an adequate space away from each other, and supported with supporting panels 3 made of an insulation material (fiber, polyester glass mat laminate, etc.), and the grids 2 are fixed to the supporting panels 3 by adhering or press-fixing.

FIG. 20 is a longitudinal section view for showing a half of a power supply side of a circuit breaker with a de-ion type arc quenching device. An end or part 5a of a stationary contact member 5 formed unitarily with a power supply terminal 4 is bent back into a U-shape along a moving contact member 1, and a stationary contact 7 for contacting a moving contact 6 of the moving contact member 1 is attached to the end 5*a* of the stationary contact member 5. And, an arc horn 9 which leads an arc caused between the stationary contact 7 and the moving contact 6 toward the arc quenching device is attached to the stationary contact member 5.

Here, a current flowing through the bent back part 5*a* of the stationary contact member 5 and a current flowing through the moving contact member 1 positioned parallel to the bent back part 5*a* flow in opposite directions as indicated by arrows A in the figure, so that an electromagnetic repulsion force acts between these currents. Therefore, the moving contact member 1 is sprung up by this electromagnetic repulsion force when a large current, such as a short-circuit current and etc., flows. As a result, the moving contact member 1 is driven quickly to an open position shown by a chain line in the figure without awaiting the operation of a switching mechanism 11 actuated by the current limiting mechanism 10. At this time, an arc 8 receives a force toward an arrow B by a magnetic field of the current flowing through the bent back part 5*a*, and is urged deeply into the arc quenching device. This arc 8 is attracted further deeply into the arc quenching device by a bias of a magnetic flux of the arc itself owing to the existence of the grids 2, and the arc voltage rises by being cut by the grids 2. At the same time, the arc 8 is cooled with an arc quenching gas caused from the insulation material constituting the supporting panels 3, and is quenched in a short time together the pressure-rise in a molded case 12.

In regard to a circuit breaker of the electromagnetic repulsion type as shown in FIG. 20, it is disclosed in Japanese Laid Open Patent Publication No. 2-132716 that a circuit breaker has a magnetic driving core of a U-shape attached to the bent back part 5*a* of the stationary contact member 5 for concentrating a magnetic flux generated by the current flowing through the bent back part 5*a* so as to enhance action of the magnetic field to the arc.

In the circuit breaker of the prior art, in which the magnetic driving core is attached to the bent back part of the stationary contact member having the stationary contact and the de-ion type arc quenching device having the piled up grids in multi-stages is disposed so as to surround the moving and stationary contacts, since the grids are connected to supporting panels by press-fitting or adhesion, it takes many steps for fixing the grids to the supporting panels. Also, the supporting panels for supporting the grids and an insulation member for covering the magnetic driving core are separately disposed to thereby form a complicated structure in the prior art as disclosed in aforementioned Japanese Laid Open Patent Publication No. 2-132716. Furthermore, since the breaker has no effective means for shielding the grids from the arc, the grids contact the arc to melt and spread, so that the metal particles thereof may be attached to the switching mechanism resulting in impeding its smooth operation or reducing insulation strength between phases and poles.

In viewing the forgoings, an object of the present invention is to provide a circuit breaker which is simplified in the peripheral structure of an arc quenching device, prevented from damage in the grids by an arc, and improved in its breaking performance.

SUMMARY OF THE INVENTION

A first aspect of the invention is achieved by a circuit breaker which is formed of a moving contact member; a stationary contact member bent back into a U-shape to extend along the moving contact member and having a stationary contact; and an are quenching device provided with grids piled up in multi-stages to surround the stationary and moving contact members, wherein an insulator having a pair of right and left side walls connected together is formed integrally by molding resin, and slots are formed on the opposed surfaces of the side walls in multi-stages. The grids are inserted into the slots.

A second aspect of the present invention is achieved by a circuit breaker which is formed of a stationary contact member which is bent back into a U-shape; a moving contact member disposed adjacent to the stationary contact member; a stationary contact disposed on the stationary contact member; a U-shaped magnetic driving core disposed near an end of the bent back part of the stationary contact member; and an arc quenching device provided with grids piled up in multi-stages so as to surround the stationary and moving contact members, wherein an insulator is formed of unitarily molding resin and includes a pair of right and left side walls connected together, and slots are formed on the opposed surfaces of the side walls of the insulator in multi-stages, into which the grids are inserted respectively. Also, hollow parts are formed in the bottom of the insulator, into which arms of the magnetic driving core are fitted.

It is preferable to mold overhangs unitarily with the insulator around the slots of the side walls, and to encapsulate or cover the grids in the overhangs for perfectly preventing the grids from damage by an arc. It is also preferable to dispose a shield wall between the side walls except a moving path for the moving contact member and to mold unitarily with the insulator at the end of a switching mechanism side of the insulator for effectively blocking an arc gas invading into the switching mechanism side.

In case the slots extend from an end surface of a power supply side to right before an end surface of a load side of the insulator, the grids inserted into the slots can be fixed and supported by a protection board mounted on the insulator. In this case, the protection board may include a gas exhausting valve, which exhausts arc gas generated at the time of breaking or cutting electric current by elastic deformation of the valve. Also, in case the slots extend from the end surface of the load side to right before the end surface of the power supply side of the insulator, the grids inserted into the slots are fixed and supported by an insulation partition mounted on the insulator.

Further, in case a width or a space between the side walls of the insulator is widened from the vicinity of the stationary contact toward the power supply side, it is effective for promoting the arc moving deeply into the grids. Also, it is possible to provide auxiliary side walls inside the side walls of the insulator to adjust the width between the side walls.

In the present invention, the slots are formed on the opposed surfaces of the side walls of the insulator molded unitarily, and the grids are inserted into the slots. As a result, the grids can be fixed by simply inserting the grids into the slots, and the press fitting or adhesion is not required for fixing the grids. The insulator is disposed over the arms of the magnetic driving core through the hollow parts formed in the bottom of the side walls thereof. Therefore, the side walls for the grids and the insulation member of the magnetic driving core are united, and the structure is simplified. The insulator formed of the molded resin can have a sufficient thickness for the side wall. If the slots are formed deep enough to hide the grids inside thereof by fully utilizing this thickness, the grids are effectively protected from the arc. However, when the overhangs are unitarily formed in the periphery of the slots so as to cover the grids and to eliminate exposed surfaces of the grids, the grids can be perfectly protected from the arc. The grids are fixed by inserting under pressure into the slots, and therefore, the assembling work is simplified by eliminating adhering or press fixing from the assembly process.

Furthermore, since an inner space of the insulator extending over the grids and the magnetic driving core is formed closely, the inner pressure rise in the periphery of the arc at current breaking becomes larger than that of the prior art, and an arc voltage rises more by increasing of an squeezing action of the arc owing to this inner pressure. And, since this inner pressure is received at first by the insulator, a pressure load to the molded case decreases, so that the pressure withstanding of the molded case is lightened. In this case, when the thickness of the side walls of the insulator is made large as aforementioned, a volume inside the insulator becomes smaller, so that the squeezing action of the arc becomes more effective. At the same time, since the arc comes close to the insulator to increase the quantity of the arc quenching gas from the insulator, the cooling effect is improved.

Moreover, when the shield wall blocking between the side walls except a moving path of the moving contact member is unitarily molded with the insulator at the end of the switching mechanism side of the insulator, the shield wall blocks the movement of an arc gas generated inside the insulator to the switching mechanism, so that danger of false operation of the switching mechanism and reduction of the insulation strength by attaching of melted metal of the contacts in the arc gas is reduced. And, since closeness of the insulator is enhanced by this shield wall, arc quenching due to the inner pressure rise is further promoted. Further, when a shield board is disposed in the opposite end of the insulator, the inner pressure rise becomes more remarkable.

The slots into which the grids are inserted are preferably formed to extend from one end side of each of the side walls to right before the other end side of each of the side walls of the insulator. In this case, an open side of the slots, i.e. insertion side of the grid, may be positioned either on the power supply side or the load side. When the grids are inserted into the slots from the power supply side, the grids can be fixed and pressed by a protection board mounted at an exhaust opening of the arc gas in the insulator for preventing invasion of foreign materials, and when the grids are inserted from the load side, the grids can be fixed and pressed by an insulation partition mounted on the insulator for preventing the arc gas from invading into the switching mechanism. The protection board may include a gas exhausting valve, which exhausts arc gas generated at the time of breaking or cutting electric current by elastic deformation of the valve, so that the arc gas can be exhausted smoothly.

When the width of the space between the side walls of the insulator is broadened from the vicinity of the stationary contact toward the power supply side, the arc formed on the stationary contact can easily move toward the power Supply side by the pressure of the arc gas to reduce wear of the stationary contact.

On the other hand, in order to increase the arc quenching ability, it is required to reduce $I^2t$ (I:flowing current, t:arc time) by increasing the arc voltage and cooling the arc. However, if the arc voltage is increased, an arc power Ap (multiplication of flowing current and arc voltage) increases to thereby increase an inner pressure. It is worried in an extreme situation that a huge inner pressure exceeds strength of the case or cover of the circuit breaker. Thus, it is required to select the width between the side walls with reference to a balance between a permitted pressure of the case or a cover and an arc quenching ability. If auxiliary side walls are installed inside the side walls as adjusting means for the width, it is possible to adjust the distance between the side walls according to the breaking or cutting capacity of the breaker while using a common insulator for the breakers with different breaking capacities.

DETAILED DESCRIPTION OF PREFERRED EMBODIMENTS

Figure 1:
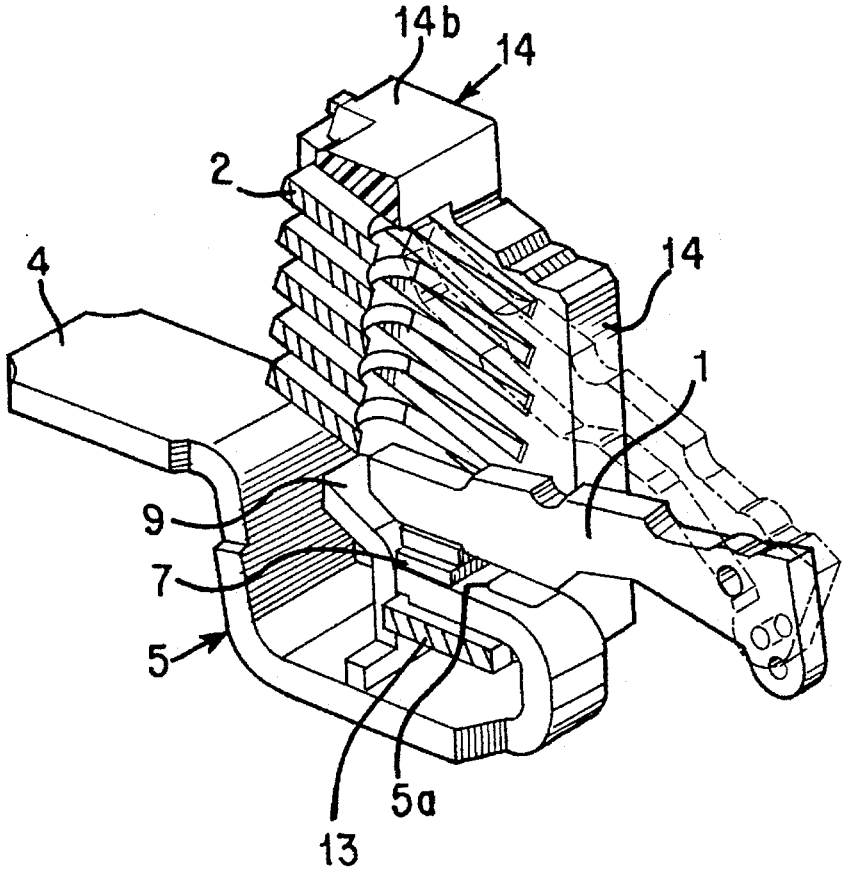
FIG. 1 is a partly cut perspective view of a main portion of a first embodiment of the present invention.

Hereinafter, embodiments of the present invention are described in detail with reference to FIGS. 1 to 18. Throughout the figures, the components corresponding to those of the prior art are designated by the same reference numerals.

Figure 2:
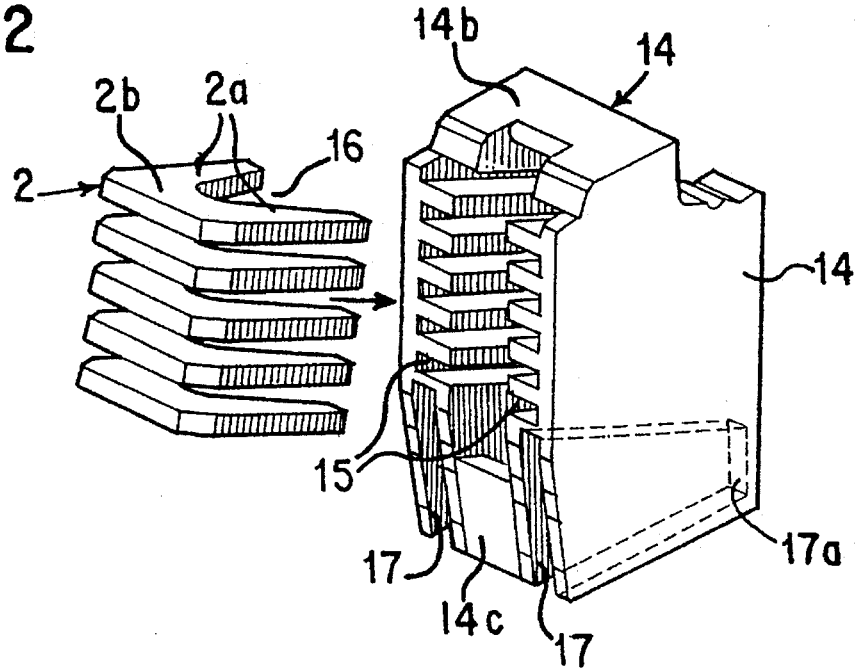
FIG. 2 is a perspective view of an insulator and grids before assembly in FIG. 1.
Figure 3:
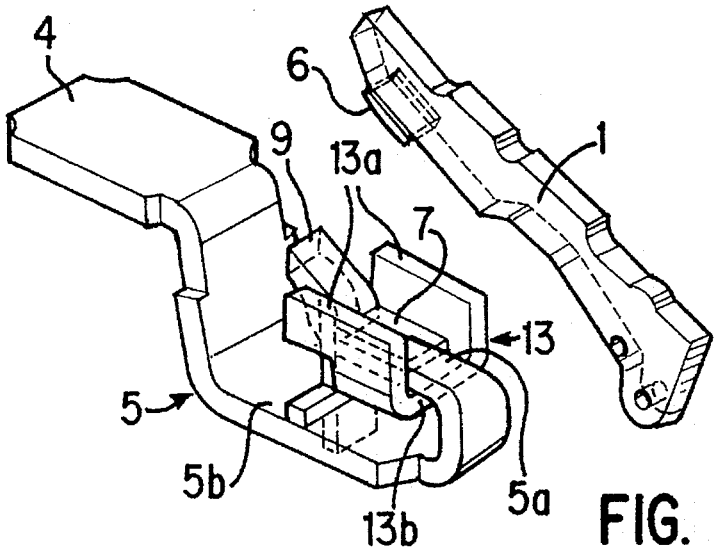
FIG. 3 is a perspective view of moving and stationary contact members in FIG. 1.

At first, FIGS. 1 to 3 show a first embodiment of the present invention. FIG. 1 shows a perspective view of moving and stationary contact members together with a longitudinally cut insulator, grids, and a magnetic driving core. FIG. 2 shows a perspective view of the insulator and grids inserted into the insulator. FIG. 3 shows a perspective view of the stationary contact member attached to the magnetic driving core and the moving contact member opened from the stationary contact member.

In FIG. 3, a stationary contact member 5 formed unitarily with a power supply terminal 4 is bent back in a U-shape to form a bent back part 5*a* in the opposite end of the terminal 4, and a stationary contact 7 is jointed on the upper surface of the end of this bent back part 5*a*. A magnetic driving core 13 is attached from the lower surface of the bent back part 5*a*. The width of the bent back part 5*a* is narrower than that of a main part 5*b* as shown in the figure. On the main part 5*b*, an arc horn 9 for leading an arc foot driven by the magnetic driving core 13 toward the side of the grids 2 is attached. A base of this arc horn 9 is inserted into a rectangular hole in the main part 5*b*, and fixed by pressing its end.

The magnetic driving core 13 is U-shaped and is formed of a pair of right and left arms 13*a* and a connection part 13*b* of these arms, and the width of the connection part 13*b* from the front to the rear is narrower than that of the arms 13*a*. Further, the width of the connection part 13*b* from right to left is wider than that of the bent back part 5*a* of the stationary contact part 5, and there is a small gap between a side surface of the bent back part 5*a* and an inner surface of the arm 13*a*, respectively, though it is not illustrated clearly. This magnetic driving core 13 is screwed to the bent back part 5*a* with a screw (not illustrated) passing through the bent back part 5*a*.

In FIG. 2, an insulator 14 is comprised of a pair of right and left side walls 14*a*, and an upper side connection part 14*b* and a front side connection part 14*c* connecting between the side walls with each other, and is unitarily molded with arc resistant molding resin of melamine group. Slots 15 with a rectangular cross section into which the grids 2 are inserted are arranged on the opposed surfaces of the right and left side walls 14*a* from the power supply side (left side in FIG. 2) to the load side (right side in FIG. 2) of the side walls 14*a* in multi-stages (5 stages in this case).

Each grid 2 has a V-shaped cutout 16 for allowing the moving contact member 1 to pass therethrough, and is inserted along the direction of an arrow in FIG. 2 into the slot 15 so as to extend between the right and left side walls. In this case, both arms 2*a* of the grid 2 are almost hidden in the slots 15, and a connection part 2*b* connecting these arms 2*a* is pushed into the insulator 14 from the front side (left side in FIG. 2) and sunk so as to allow the tips of the arms 2*a* to abut against the end wall of the slots 15. The thickness of the grid 2 is slightly greater than the width of the slot 15, and therefore, the grid 2 is fixed by pushing into the slot under pressure.

Furthermore, hollow parts 17 are formed from the bottom of the right and left side walls 14*a* of the insulator 14 and opened also on the front side, and the insulator 14 is fitted through these hollow parts 17 onto the arms 13*a* of the magnetic driving core. In this case, the inner part of each side wall separated right and left by the hollow part 17 is inserted into the aforementioned gap between the bent back part 5*a* of the stationary contact member and the arm 13*a* of the magnetic driving core 13 to abut against the connection part 13*b* of the magnetic driving core 13, so that the insulator 14 is positioned in the right and left and vertical directions. And, the end wall 17*a* of the hollow part 17 abuts against the front end surface of the arm 13*a* of the magnetic driving core 13 shown in FIG. 3, and is positioned in the front direction. FIG. 1 shows the state of fitting the magnetic driving core 13 into the insulator 14 holding the grids 2. This insulator 14 is fixed at the front corners of upper connection parts 14*b* in FIG. 1, and held down by a molded cover (not shown) in a mold case (not shown).

In the embodiment described above, supporting panels for supporting the grids and an insulation member for insulating the magnetic driving core are unitarily molded as the insulator 14. Therefore, the two parts in the prior art are united into one part, resulting in a simplified structure. In the unitarily molded insulator 14 made of resin, the thickness of the side walls 14*a* for supporting the grids 2 is made larger than that of the prior art to support panels as shown in the figure, so that the both arms 2*a* of the grids 2 can be almost hidden in the slots 15. Therefore, the both arms 2*a* are hardly damaged by an arc, and melted metals do not scatter. Further, since the grids 2 are fixed only by pushing into the slots 15 under pressure, work, such as adhering or press-fitting, is unnecessary.

While, the insulator 14, which extends over the grids 2 and the magnetic driving core 13 and has the right and left side walls 14*a* opposing through a narrow interval, covers the inner space closely. Therefore, an inner pressure rise in the periphery of the arc caused by the yielded arc gas becomes large, and a voltage rise of the arc squeezed by this pressure rise is remarkable. In this case, since this inner pressure is received at first by the insulator 14, though the pressure rise is great, a pressure load to the molded case is light.

Moreover, since the side walls 14*a* with the large thickness easily contact the arc, a large quantity of the arc quenching gas is generated from the insulator 14, so that the arc is de-ionized and at the same time is cooled on the wall surfaces of the insulator 14 at a comparatively low temperature to quickly recover an insulation ability. In this case, for improving arc quenching performance it is effective to use polymethylpentene resin, polymethylmethacrylate resin, polyacetal resin, ploybutylenterephthalate, polycabonate resin, and so on which easily generate a hydrogen gas having high arc cooling effect.

Figure 4:
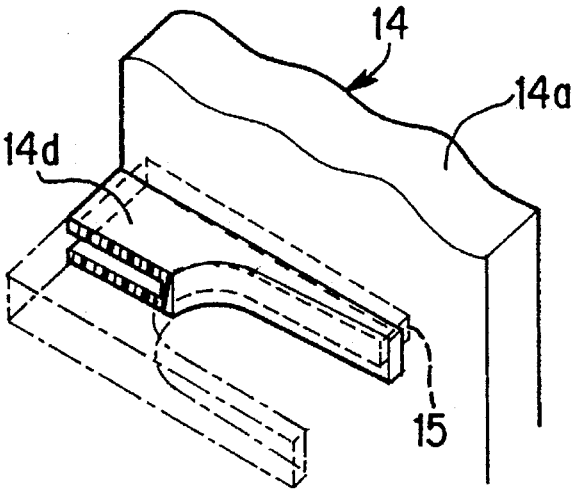
FIG. 4 is a perspective view of a main portion viewed from an inner side of a side wall of an insulator showing a second embodiment of the invention.

FIG. 4 shows a perspective view of a main part of a second embodiment, in which an overhang 14d for covering the grid 2 is unitarily molded in the periphery of the slot 15 of the side wall 14*a* of the insulator 14. In this figure, a half side of the overhang 14*d* cut through its center is shown from the inside of the side wall 14*a*. The overhang 14*d* is formed in a U-shape extending between the right and left side walls 14*a*, and in a bag form opened only at the front end (left end in the figure). In this structure, the grids 2 are encapsulated or covered entirely on the upper and lower surfaces and the inner periphery along the U-shaped end surface exposed to the outside of the slots 15 by the insulator 14, and therefore, are perfectly protected from the arc.

Figure 5:
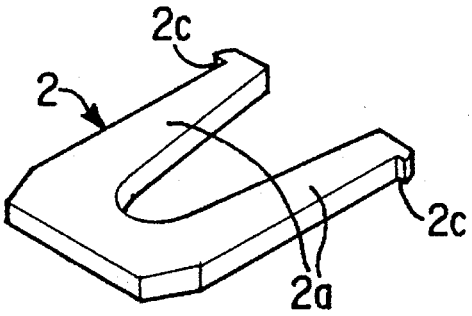
FIG. 5 is a perspective view of the grids showing a third embodiment of the invention.

FIG. 5 shows a third embodiment of the grid unitarily arranged with nails 2*c* outside the tip of the both arms 2*a*, which bite into the bottoms of the slots 15. Since the width between the side portions of the nails 2*c* is slightly larger than the space between the bottoms of the slots 15, the nails 2*c* move deeply into the slots as the arms 2*a* are elastically deformed inward when the grid 2 is pushed into the slots 15 under pressure, and bite into the bottom of the slots 15. By this structure, the grids 2 are more securely fixed, so that the grids 2 cannot vibrate with an alternating magnetic field caused by a current flowing through the circuit breaker.

Figure 6:
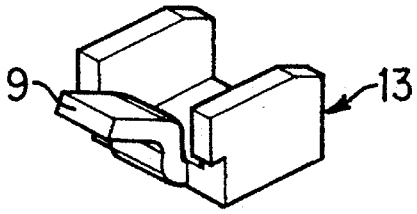
FIG. 6 is a perspective view of a magnetic driving core showing a fourth embodiment of the invention.

FIG. 6 shows a fourth embodiment, in which the arc horn 9 is unitarily formed with the magnetic driving core 13. The magnetic driving core 13 can be formed from, e.g. a steel plate by press work, and since the arc horn 9 is cut and bent at the same time, number of parts is reduced to more simplify the structure.

Figure 7A:
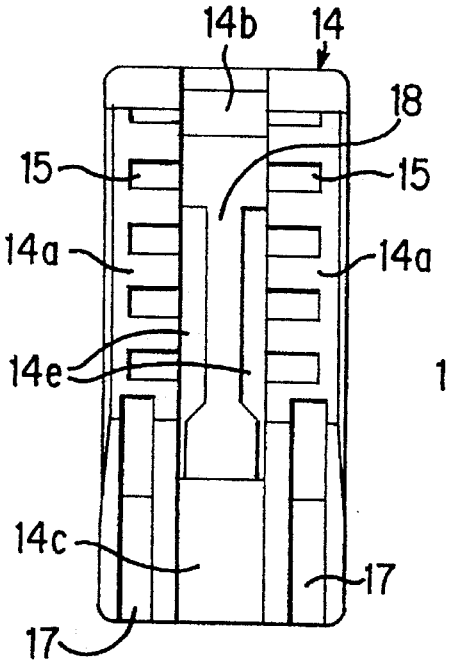
FIG. 7(A) is a front view of an insulator for showing a fifth embodiment of the invention.
Figure 7B:
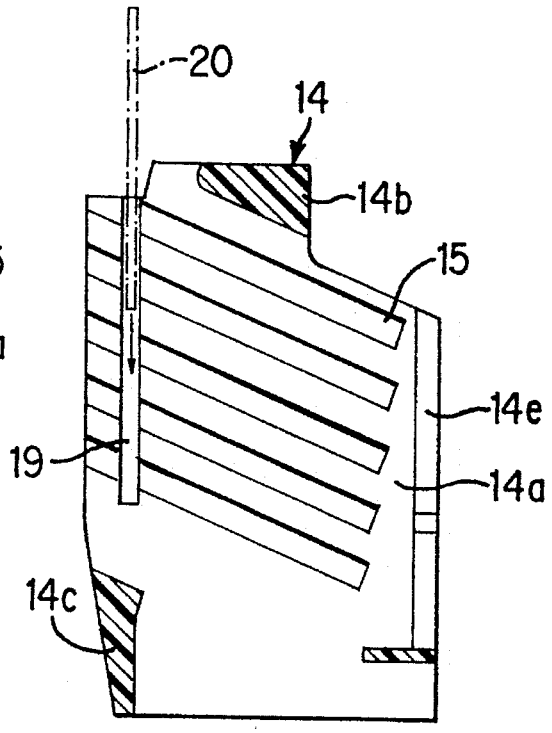
FIG. 7(B) is a longitudinal section view of the insulator in FIG. 7(A)

FIGS. 7(A) and 7(B) show a fifth embodiment, in which a shield wall 14*e* blocking between the side walls 14*a* is unitarily formed on the end of the insulator 14 at the side of the switching mechanism, wherein FIG. 7(A) shows a front view, and FIG. 7(B) shows a longitudinal sectional view. A slit 18 is vertically formed along the moving path of the moving contact member 1 on the shield wall 14*e*. According to this structure, since moving of the arc gas generated in the insulator 14 to the switching mechanism is blocked by the shield wall 14*e*, the danger of a false operation of the switching mechanism and reduction of the insulation strength by attaching of the melted metals of the contacts are reduced. Further, the arc quenching action by the inner pressure rise is promoted as the inner space of the insulator 14 is closed.

In the embodiment shown in FIGS. 7(A) and 7(B), vertical slots 19 are formed on the opposed surfaces of the side walls 14*a* in the front side of the insulator 14 (left side in the figure) crosswise to the slots 15. In the vertical slots 19, a rectangular shield board 20 (shown with a chain line) made of fibers and so on is inserted as shown by an arrow. According to this structure, the inner pressure rise becomes more remarkable, so that the arc quenching performance is more improved. If the inner pressure rise is so large that the insulator 14 may be damaged, the inner pressure may be adjusted by adequately opening holes in the shield board 20. This kind of the shield board is usually attached to a molded case of a circuit breaker. However, when the shield board 20 is attached to the insulator 14, the shield board 20 is integrated with the arc quenching device to simplify the structure.

Figure 8A:
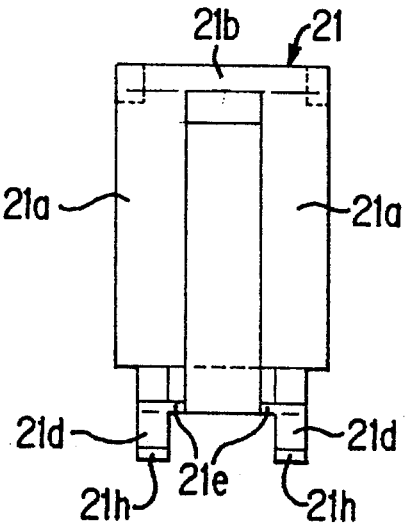
FIG. 8(A) is a front view of a protection board for showing a sixth embodiment of the invention.
Figure 8B:
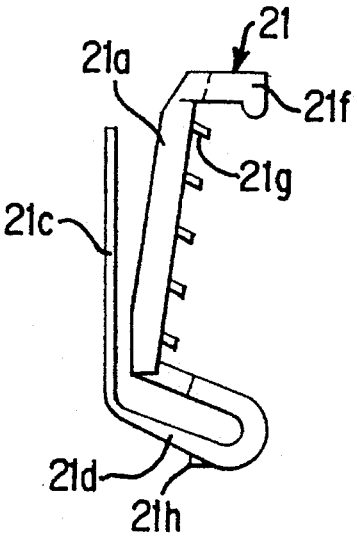
FIG. 8(B) is a side view of the protection board shown in FIG. 8(A)
Figure 9A:
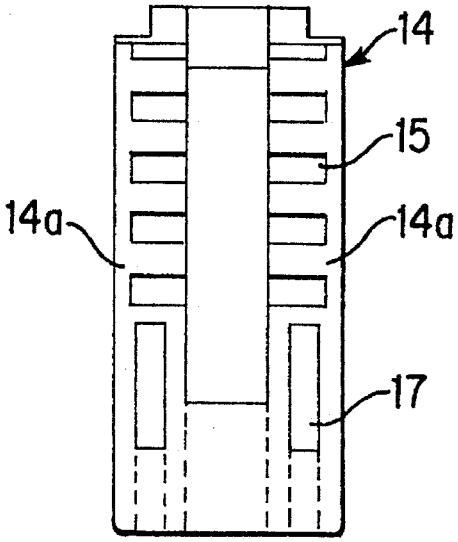
FIG. 9(A) is a front view of an insulator, on which the protection board shown in FIG. 8(A) is mounted.
Figure 9B:
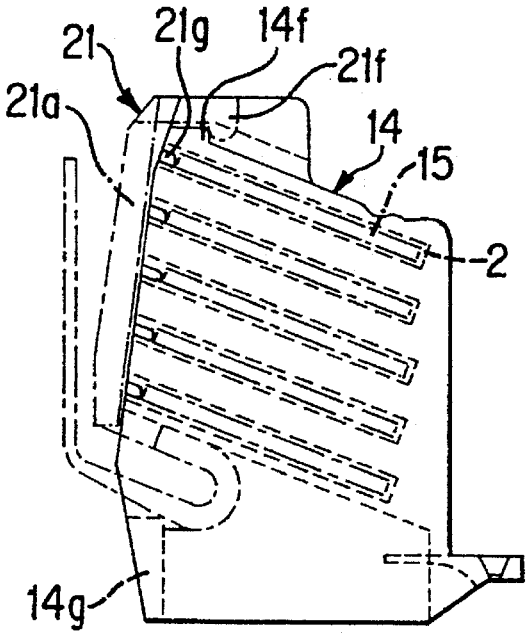
FIG. 9(B) is a side view of the insulator shown in FIG. 9(A)

FIGS. 8(A), 8(B), 9(A), and 9(B) show a sixth embodiment, in which the grids inserted into the insulator from the power supply side are fixed with a protection board. FIG. 8(A) shows a front view of the protection board, and FIG. 8(B) shows its side view. FIG. 9(A) shows a front view of the insulator, and FIG. 9(B) shows its side view. In this embodiment, a shield board for the inner pressure rise is not attached in the insulator 14. However, the protection board 21 is mounted on the insulator 14 for preventing foreign materials from invading through an exhaust opening (left side opening in FIG. 9 (B)).

The protection board 21 is unitarily molded into the form as shown in FIGS. 8(A) and 8(B) with arc resistant resin, such as nylon etc., and is comprised of a pair of right and left pressing boards 21*a* extending along the power supply side of the side walls 14*a* of the insulator 14 (left side in FIG. 9 (B)); a connection board 21*b* connecting between these pressing board 21*a* in the upper end; a rectangular blocking board 21*c* closing an opening between the pressing boards 21*a* through a space in the front and rear directions; a pair of right and left U-shaped attaching feet 21*d*, each being connected at one end to the pressing board 21*a*; a pair of connecting bars 21*e*, each connecting the other end of the attaching foot 21*d* to the lower end of the blocking board 21*c*; and a pair of right and left hooks 21*f* extending from the upper ends of the pressing boards 21*a*. Further, pressing projections 21*g* are disposed on the surfaces of the pressing boards 21*a* opposed to the side walls 14*a* (right side in FIG. 8 (B)). The projections 21*g* are arranged in multi-stages to fit into the slots 15, and claws or projections 21*h* are arranged on the lower surface of the attaching feet 21*d*.

On the other hand, in the insulator 14, the slots 15 are formed from the end surface of the power supply side to right before the end surface of the load side of the side walls 14*a*, and engaging steps 14*f* are formed to fit to the hooks 21*f* of the protection board 21 on the upper part of the side wall 14*a*. After the grids 2 are inserted into the slots 15, the hooks 21 are engaged with the engaging steps 14*f*, and the attaching feet 21*d* are pushed into the hollow parts 17, so that the protection board 21 is mounted as shown by a chain line in FIG. 9(B). In this case, walls 14*g* are arranged in the front lower part of the hollow parts 17, and the attaching feet 21*d* pushed into the hollow parts 17 are fixed by engaging the claws 21*h* with the walls 14*g*. In this state, the pressing boards 21*a* contact the end surfaces of the side walls 14*a*, and the grids 2 are fixed and pressed by the pressing projections 21*g*. Therefore, the grids 2 are surely fixed even when vibration occurs if the grids are simply pushed under pressure. The protection board closes, through the gap, the opening of the insulator 14 to block invasion of foreign materials, such as waste wire etc., and to exhaust the arc gas through the above described gap.

Figure 10:
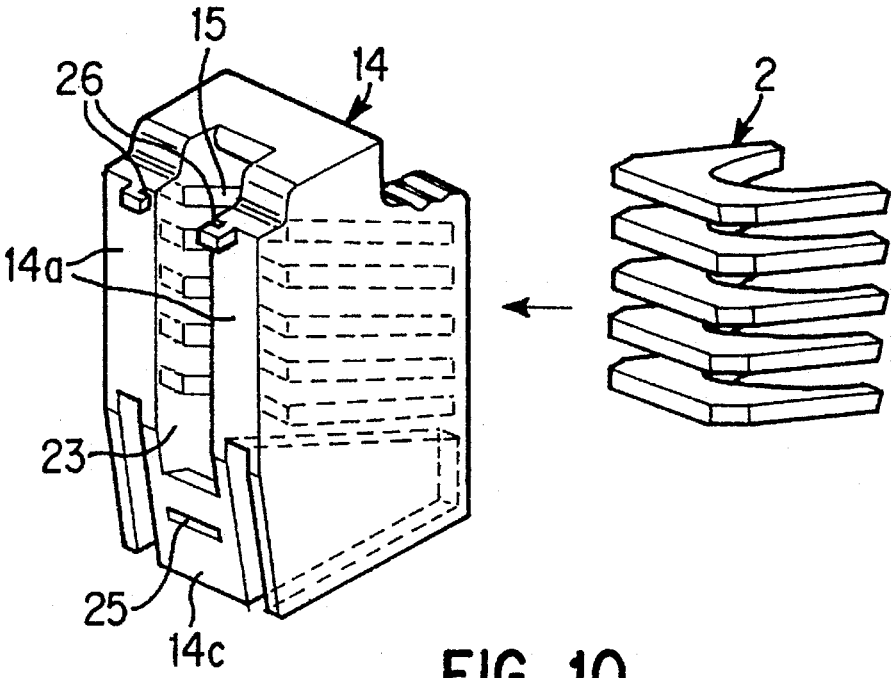
FIG. 10 is a perspective view of an insulator and disassembled grids for showing a seventh embodiment of the invention.
Figure 11:
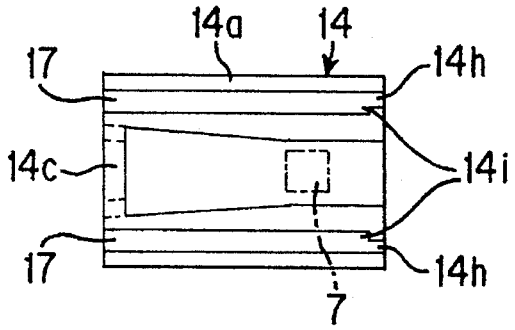
FIG. 11 is a bottom view of the insulator shown in FIG. 10.
Figure 12A:
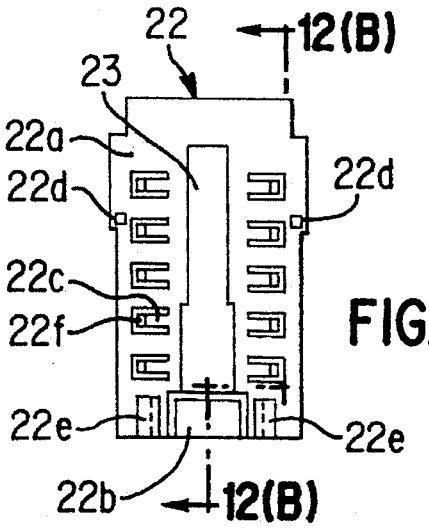
FIG. 12(A) is a front view of an insulation partition mounted on the insulator shown in FIG. 10.
Figure 12B:
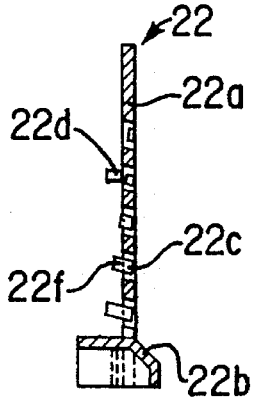
FIG. 12(B) is a sectional view of the insulation partition taken along a line 12(B)—12(B) in FIG. 12(A)
Figure 12C:
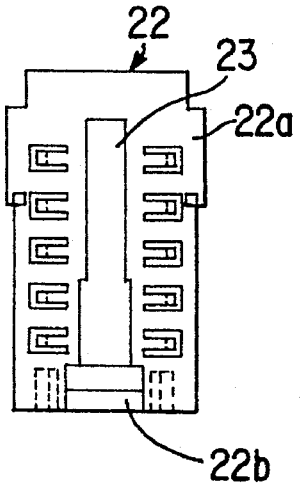
FIG. 12(C) is a rear view of the insulation partition.
Figure 12D:
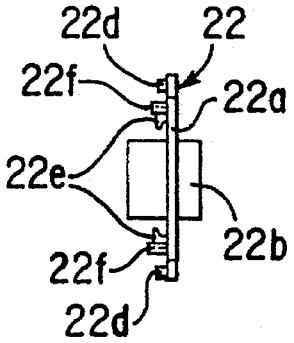
FIG. 12(D) is a top plan view of the insulation partition shown in FIG. 12(B)
Figure 13A:
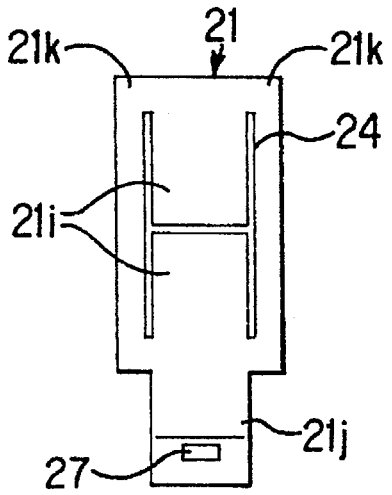
FIG. 13(A) is a front view of a protection board mounted on the insulator shown in FIG. 10.
Figure 13B:
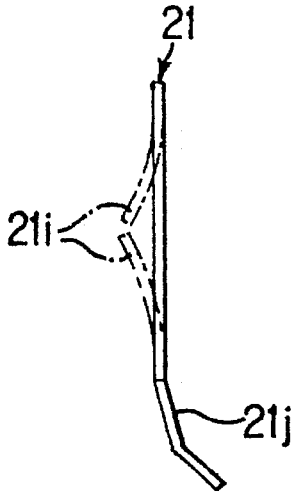
FIG. 13(B) is a side view of the protection board shown in FIG. 13(A)
Figure 14:
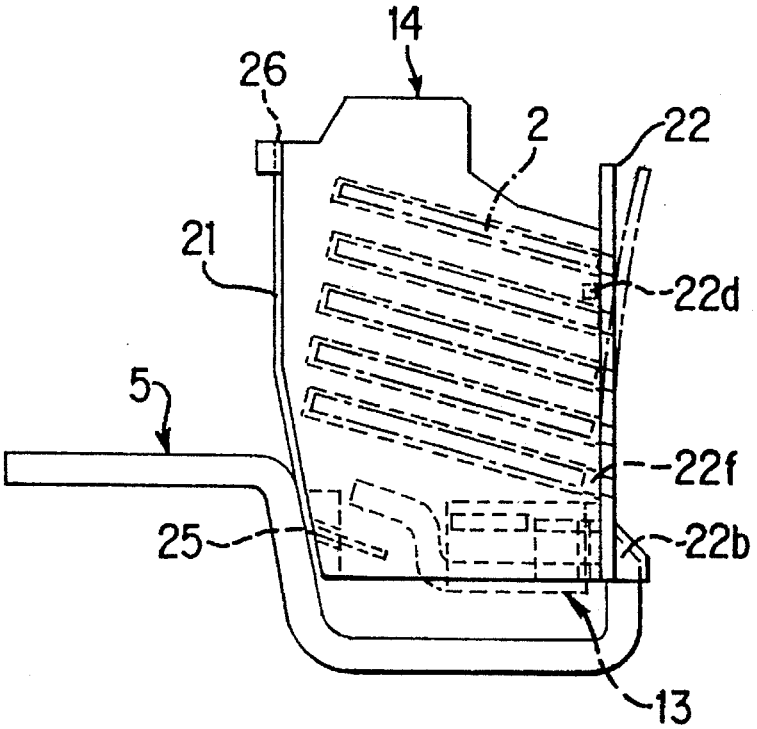
FIG. 14 is a side view of a stationary contact member on which the insulator shown in FIG. 10 is mounted.

FIGS. 10 to 14 show a seventh embodiment, in which the grids inserted from the load side into the insulator are fixed by pressing with an insulation partition. FIG. 10 shows a perspective view of an insulator and grids inserted into the insulator; FIG. 11 is a bottom view of the insulator; FIG. 12(A) is a front view of the insulation partition; FIG. 12(B) is a sectional view taken along a line 12B—12B in FIG. 12(A); FIG. 12(c) is a rear view; FIG. 12(D) is a top plan view of FIG. 12(B); FIG. 13(A) is a front view of a protection board; FIG. 13(B) is a side view; and FIG. 14 is a side view in the state that the insulator in FIG. 10 is mounted on a stationary contact member.

As shown in FIG. 10, in the insulator 14 of this embodiment, slots 15 are formed from the end surface of the load side to right before the end surface of the power supply side of the side walls 14*a*, and the grids 2 inserted from the load side along an arrow into the slots 15 are fixed, as shown in FIG. 14, with their end surfaces held down by the insulation partition 22 mounted on the insulator 14. The insulation partition 22 is mounted in place of the shield wall 14*e* unitarily molded with the insulator 14 shown in FIGS. 7(A) and 7(B). Therefore, the insulation partition 22 blocks movement of an arc gas generated in the insulator 14 to a switching mechanism, and prevents false operation of the switching mechanism and reduction of insulation strength by attaching of melted metals of the contacts and etc.

In FIGS. 12(A)–12(D), the insulation partition 22 unitarily molded with arc resistant resin, such as polyester, is comprised of a partition 22*a* having a slit 23 along the moving path of the moving contact member 1 (FIG. 3), and a U-shaped contact member cover 22*b* for covering a bent part of the stationary contact member 5 (FIG. 14). In the partition 22*a*, tongue-shaped pressing pieces 22*c* for pressing the grids 2 are formed by C-shaped grooves and vertically arranged on both sides of the slit 23, and outside of the pressing pieces 22*c*, a pair of right and left projections 22*d* for engaging the insulator 14 as described later are formed. Furthermore, on both sides of the contact member cover 22*b*, a pair of right and left hooks 22*e* for engaging the insulator 14 as described later are formed. In the tips of the pressing pieces 22*c*, pressing projections 22*f* are formed corresponding to the end surface positions of the vertically piled-up grids such that the protruding lengths thereof gradually increase from the top to the bottom.

The insulation partition 22 is fitted from its bottom onto the insulator 14 into which the grids are inserted. That is, as shown in FIG. 11, slits 14*h* engaging the hooks 22*e* of the insulation partition 22 are formed, in which engaging steps 14*i* are formed. The contact member cover 22*b* of the insulation partition 22 is fitted to the space 23 between the side walls 14*a* of the insulator 14 from the bottom, and at the same time, the base parts of the hooks 22*e* are fitted to the slits 14*h*, and thereafter, the insulation partition 22 is pushed upward into the insulator 14 from below. During this step, the partition 22*a* is elastically bent by the projections 22*d* interfered with the end surfaces of the side walls as shown by a chain line in FIG. 14, but when the projections 22*d* reach holes (not illustrated) arranged on the end surfaces of the side walls 14*a*, the projections 22*d* fall in and engage these holes, so that the insulation partition 22 is mounted as shown by a solid line in FIG. 14. In this state, the pressing projections 22*f* of the insulation partition 22 press the end surfaces of the grids 2 and fix the grids 2.

In FIGS. 13(A) and 13(B), a protection board 21 in this embodiment has a pair of upper and lower tongue-shaped flaps 21i formed by an H-shaped groove 24, and an attaching part 21*j* slightly bent outwardly is formed in the lower part. For this protection board 21, in FIG. 10, a slit-shaped attaching hole 25 is opened horizontally through the connection part 14*c* of the insulator 14 corresponding to the attaching part 21*j* of the protection board 21. And, attaching slots 26 are formed on the upper parts of the power supply side end surface of the side walls so as to fit right and left shoulders 21*k* of the protection board 21. Thus, the protection board 21 is mounted on the insulator 14 as shown in FIG. 14 such that at first the upper shoulders 21*k* are inserted into the attaching slots 26 from below, and then, the attaching part 21*j* is inserted into the attaching hole 25 from the front. Though not illustrated, an engaging projection is formed on the lower portion of the attaching hole 25, and a hole 27 of the attaching part 21*j* inserted into the attaching hole 25 is engaged with and caught in this engaging projection.

In the protection board 21, the flaps 21*i* are opened by the inner pressure rise in the insulator 14 as shown by a chain line in FIG. 13(B) at current breaking to exhaust an arc gas. As shown in FIG. 11, the space 23 between the side walls 14*a* of the insulator 14 is broadened from the vicinity of the stationary contact 7 toward the power supply side. Since this structure facilitates expansion of the arc gas toward the power supply side, an arc generated on the stationary contact 7 is promoted to move toward the power supply side by the pressure of the arc gas. Thus, the period that the arc stays on the stationary contact 7 becomes shorter, so that wear of the stationary contact 7 is reduced. The insulator 14 on which the protection board 21 and the insulation partition 22 are mounted is fitted, as shown in FIG. 14, through the hollow parts 17 onto the magnetic driving core 13. In FIG. 14, the magnetic driving core 13 formed unitarily with the arc horn 9 is used.

Figure 15:
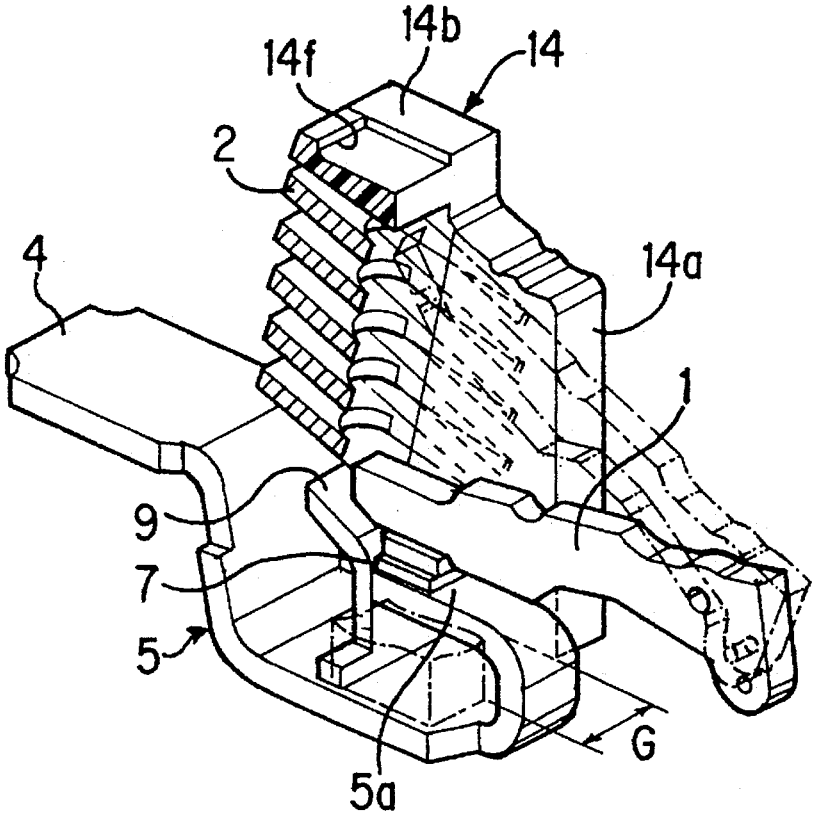
FIG. 15 is a partly cut perspective view of a main portion of an eighth embodiment of the present invention.
Figure 16:
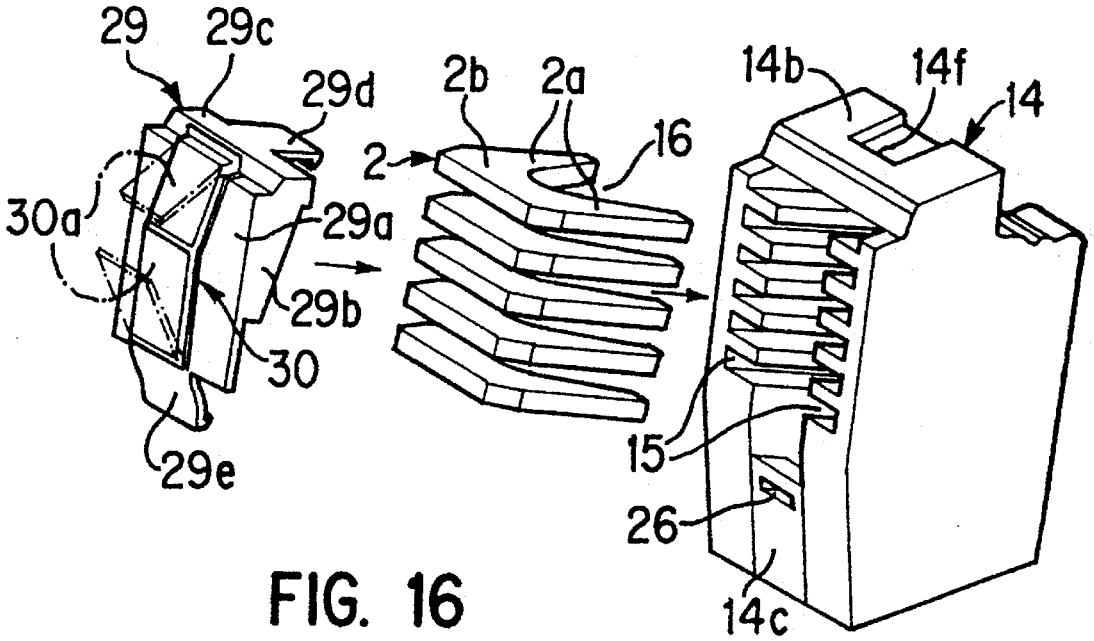
FIG. 16 is a perspective view for showing a disassembled condition of the embodiment shown in FIG. 15.

The above embodiments relate to the circuit breakers having the magnetic driving cores 13, but a different embodiment is shown in FIGS. 15 and 16, wherein the structure for supporting the grids by the insulator formed of molding resin is applied to a circuit breaker without a magnetic driving core. FIG. 15 shows a perspective view for the stationary and moving contact members in a condition that the insulator and grids are cut vertically, and FIG. 16 is a perspective exploded view of the main part thereof. The embodiment has the structure substantially the same as in the embodiment shown in FIGS. 1 and 2 except for the magnetic driving core.

In this case, the insulator 14 is supported such that the lower surfaces of the side walls 14*a* abut against the upper surface of the main part 5*b* of the stationary contact part 5. Also, a protection board 29 which has a function of pushing the grids 2 is provided with a gas exhausting valve, as shown in FIG. 16. In this case, the portions of the insulator 14 around the slots 15 where the arms 2*a* of the grids 2 are inserted are closed at the inner portions thereof, so that the arms 2*a* of the grids 2 are completely shielded from the arc.

As shown in FIG. 16, the protection board 29 is integrally molded by resin having flexibility and strength against arc, such as nylon, and includes a front plate 29*a*, side plates 29*b* at both sides of the front plate 29*a*, and an upper plate 29*c*. At a portion extending from the upper plate 29*c*, an upper hook 29*d* is formed, and at a portion extending from the front plate 29*a*, a lower hook 29*e* is formed. A gas exhausting valve 30 is formed such that an H-shape slit is formed in the front plate 29*a* similar to that shown in FIGS. 13(A) and 13 (B) to thereby form a pair of valve members 30*a*. When electricity is cut or broken, the valve members 30*a* deform as shown in chain lines by a gas pressure to exhaust the arc gas.

When the protection board 29 is installed, the lower hook 29*e* is inserted into a hole 26 of the insulator 14 to engage projections (not shown), and then the upper hook 29*d* is engaged with an engaging step 14*f*, so that the protection board 29 is fixed to the insulator 14. In the fixed condition, the side plates 29*b* of the protection board 29 face end of the slots 15, so that the grids 2 are held in the insulator 14.

Figure 18:
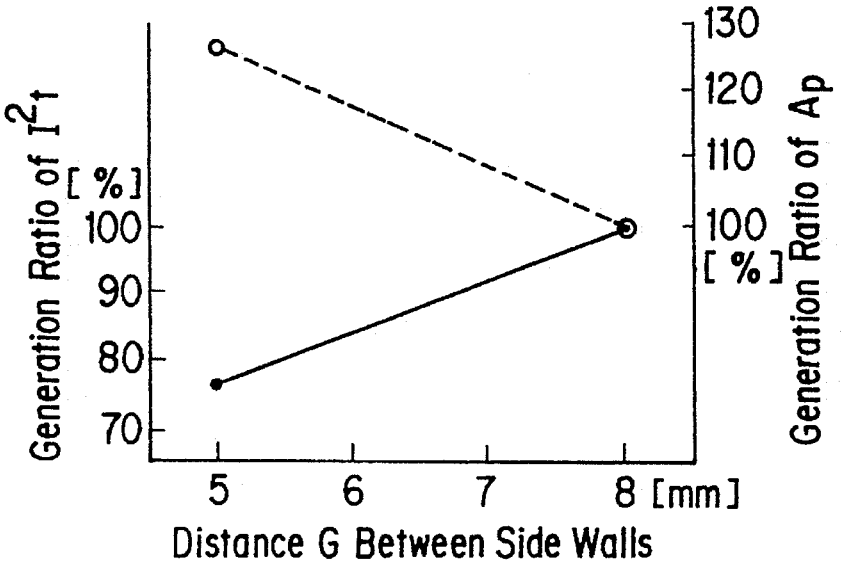
FIG. 18 is an explanatory view for showing a relation of $I^2t$ and arc power Ap relative to width G of the insulator.
Figure 19:
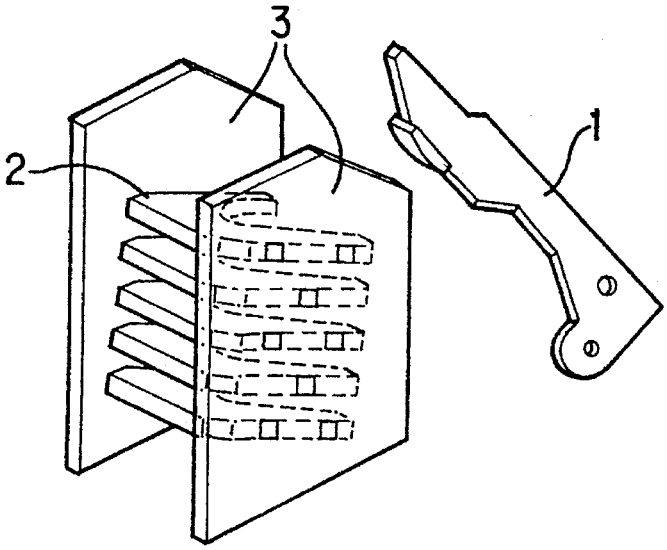
FIG. 19 PRIOR ART
FIG. 19 is a perspective view of an arc quenching device according to the prior art.
Figure 20:
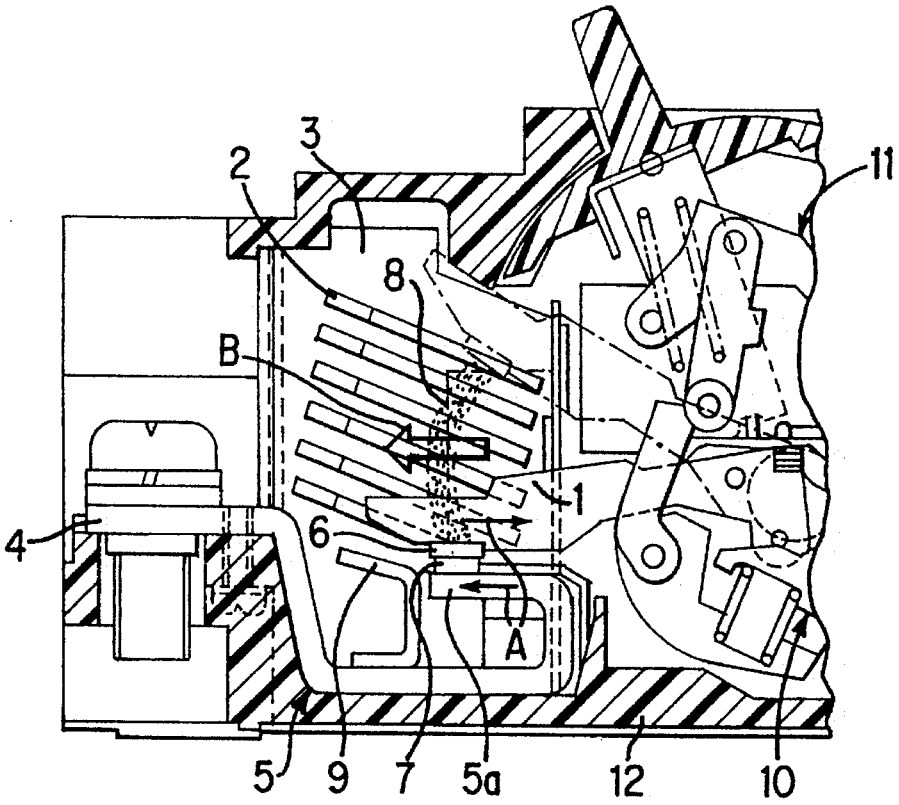
FIG. 20 PRIOR ART
FIG. 20 is a longitudinal section view of a part of a circuit breaker with the arc quenching device of the prior art shown in FIG. 19.

On the other hand, $I^2t$ (I:flowing current, t:arc time or duration) and the arc power Ap (multiplication of flowing current and arc voltage) at the time of breaking of electric current explained before are affected by the distance G between the side walls 14*a* of the insulator 14 (refer to FIG. 15). FIG. 18 illustratively shows the relationship thereof in case that G=8 mm is 100%. In the figure, as the distance reduces, $I^2t$ reduces, and on the contrary, Ap increases. This is because as the distance G between the side walls becomes narrower, the space inside the insulator 14 is reduced, and on the other hand, gas generation increases due to close distance between the arc and the side walls. As a result, electric current I is reduced by increasing the squeezing and cooling operations of the arc, while the arc voltage is increased more. Namely, the arc quenching ability is increased as the distance G is reduced. However, as the arc power Ap increases, the inner pressure of the circuit breaker increases accordingly. As a result, load against the case or the cover increases to possibly cause a dangerous situation of breaking the case or cover. Therefore, it is required to set the distance G between the side walls with reference to the breaking capacity and the strength of the case or cover of the circuit breaker.

Figure 17:
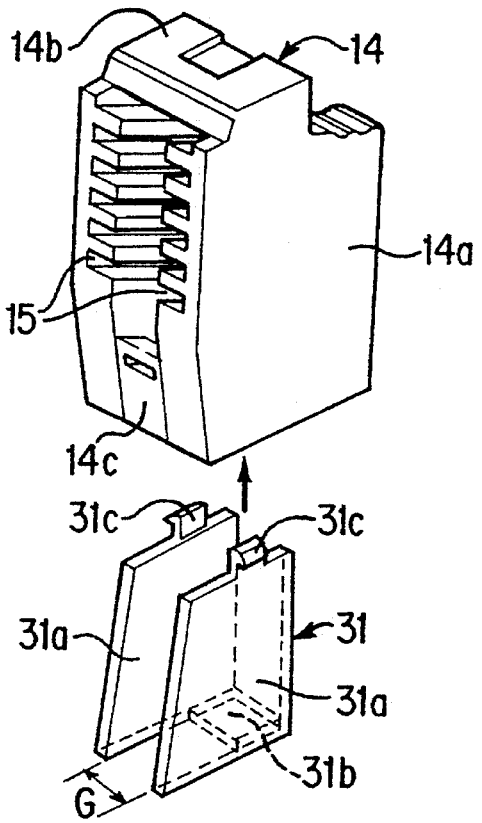
FIG. 17 is a perspective view of an insulator and auxiliary side walls attached thereto for showing a ninth embodiment of the invention.

FIG. 17 is an embodiment showing that the distance G between the side walls can be adjusted easily by attaching auxiliary side walls 31. The auxiliary side walls 31 are made of molded resin as in the insulator 14, and includes a pair of upstanding side walls 31*a* and a horizontal connecting plate 31*b* for connecting the side walls 31*a* at a lower side near the switching mechanism (right side in FIG. 17). Hook 31*c* are formed at upper ends of the side walls 31*a*. As shown in the drawing, the auxiliary side walls 31 are inserted into the insulator 14 from the lower portion thereof, and are fixed thereto by engaging the hooks 31*c* to concaves (not shown) inside the upper side walls 14*a*. When the insulator 14 with the auxiliary side walls 31 is fixed to the stationary contact part 5, the connecting plate 31*b* of the auxiliary side walls 31 contacts the upper surface of the bent back part 5*a* of the stationary contact part 5. In this structure, since the auxiliary side walls 31 with a different distance G is installed, it is possible to set a desired distance G between the side walls by using one insulator 14 according to the requirement of the respective circuit breakers and the strength of the case or cover.

As has been explained, according to the invention, the insulator having a pair of right and left side walls connected with one another is unitarily molded with molding resin; the grids are inserted into the slots arranged on the opposed side walls of the insulator; and the insulator is fitted through the hollow parts formed in the bottom of the insulator into the arms of the magnetic driving core. Thus, the following effects are obtained:

(1) Since the supporting panels for the grids and the insulation member for the magnetic driving core are integrally formed, the structure is simplified, and the assembling work and parts management are facilitated.

(2) Since the side walls of the insulator made of molding resin can be sufficiently thick, the slots can be formed deep enough to hide the grids so as to protect the grids from the arc. Especially, when the overhangs for covering the grids are unitarily formed in the vicinity of the slots, the surfaces of the grids are not exposed and damage of the grids by the arc can be perfectly prevented.

(3) Since the grids can be fixed only by inserting into the slots under pressure, adhering or press-fixing is unnecessary and assembling work time is reduced.

(4) Since an inner space of the insulator extending over the grids and the magnetic driving core is closed, an inner pressure rise in the periphery of the arc caused by an arc gas is remarkable, so that an arc voltage rise by squeezing action of the arc is enhanced.

(5) Since the inner pressure rise can be received by the insulator, a pressure load to a molded case is reduced and a design condition of pressure withstanding for the molded case is lightened.

(6) Since the thickness of the side walls of the insulator is made large, the insulator is formed close to the arc so as to cause a large quantity of the arc gas, so that a cooling effect of the arc can be enhanced.

(7) When the shield wall blocking between the side walls except a moving path of the moving contact member is formed in an end of the insulator at the switching mechanism side and further a shield board is mounted on the opposite side, the inner pressure is further risen remarkably, and an arc quenching action by squeezing of the arc is further enhanced.

(8) The grids can be inserted into the insulator either from the power supply side or the load side. The grids are fixed by pressing with the protection board mounted on the insulator when inserting the grids from the power supply side, or in the same manner with the insulation partition when inserting the grids from the load side. In either case, a vibration caused by an alternating magnetic field can be effectively suppressed.

(9) By broadening a space or width between the side walls of the insulator from the vicinity of the stationary contact toward the power supply side, the arc is promoted to move toward the power supply side by the pressure of the arc gas, and the stay period of the arc on the stationary contact becomes shorter, so that wear of the stationary contact is reduced.

(10) The auxiliary side walls are installed within the right and left side walls of the insulator, so that it is possible to set a desired distance G between the side walls according to the requirement of the respective circuit breakers and the strength of the case or cover.

What is claimed is:

1. A circuit breaker comprising:

a stationary contact member bent back into a U-shape and having a stationary contact at a bent back portion thereof;

a U-shaped magnetic driving core disposed at the bent back portion of the stationary contact member and having arms extending upwardly from the bent back portion;

a moving contact member situated adjacent to the stationary contact member to be able to contact with the stationary contact;

a plurality of grids laminated vertically with a space therebetween and situated adjacent to the stationary contact member to surround the same; and a unitary molded insulator situated around the stationary and moving contact members, said insulator including a pair of side walls facing to each other, each side wall having a hollow part extending upwardly from a lower end thereof, and a plurality of slots arranged in the opposed side walls to vertically space apart from each other so that when the circuit breaker is assembled, the side walls are located to sandwich the stationary and moving contact members while the arms of the magnetic driving core are located in the hollow parts of the side walls, and the grids are inserted into the slots and vertically piled together.

2. A circuit breaker as claimed in claim 1, further comprising a shield wall disposed between said side walls and having a moving path for said moving contact member, said shield wall being unitarily molded with said insulator at an end near the switching mechanism.

3. A circuit breaker as claimed in claim 1, wherein said slots extend from an end surface at a side of a load to a portion near an end surface at a side of a power supply, said circuit breaker further including an insulation partition attached to said end surface near the load so that said grids inserted into said slots are fixed and pressed by the insulation partition mounted on said insulator.

4. A circuit breaker as claimed in claim 3, wherein said insulation partition includes a plurality of projections contacting the grids to immovably hold the grids in the insulator.

5. A circuit breaker as claimed in claim 1, wherein a width between the side walls of the insulator is broadened from a vicinity of the stationary contact toward a power supply side.

6. A circuit breaker as claimed in claim 1, wherein said grid includes projections at outer side portions so that the grid surely engages the insulator.

7. A circuit breaker comprising:

a stationary contact member bent back into a U-shape and having a stationary contact at a bent back portion thereof;

a moving contact member situated adjacent to the stationary contact member to be able to contact with the stationary contact;

a plurality of grids laminated vertically with a space therebetween and situated adjacent to the stationary contact member to surround the same; and a unitary molded insulator situated around the stationary and moving contact members, said insulator including a pair of side walls facing to each other, a plurality of slots arranged in the opposed side walls to vertically space apart from each other, and a plurality of overhangs unitarily molded with the insulator, each of the overhangs extending between the side walls to surround two slots formed in the side walls and facing with each other to form a space in the overhang so that one of the grids is inserted into the space and the two slots and is substantially covered by the overhang, said grids being vertically piled and covered by the overhangs.

8. A circuit breaker as claimed in claim 7, wherein each overhang includes upper and lower portions to form said space therebetween, and open and closed sides situated between the upper and lower portions, one of the grids being inserted into the space through the open side.

9. A circuit breaker comprising:

a stationary contact member bent back into a U-shape and having a stationary contact at a bent back portion thereof;

a moving contact member situated adjacent to the stationary contact member to be able to contact with the stationary contact;

a plurality of grids laminated vertically with a space therebetween and situated adjacent to the stationary contact member to surround the same;

a unitary molded insulator situated around the stationary and moving contact members, said insulator including a pair of side walls facing to each other, and a plurality of slots arranged in the opposed side walls to vertically space apart from each other and extending from one end surface of the insulator toward the other end surface thereof so that the grids are inserted into the slots and vertically piled together; and a protection board attached to said one end surface so that the grids inserted into the slots are fixed and pressed by the protection board mounted on the insulator, said protection board having a gas exhaustion valve having flexibility so that an arc gas generated at a time of breaking of electric current is exhausted by deformation of the exhaustion valve.

10. A circuit breaker comprising:

a stationary contact member bent back into a U-shape and having a stationary contact at a bent back portion thereof;

a moving contact member situated adjacent to the stationary contact member to be able to contact with the stationary contact;

a plurality of grids laminated vertically with a space therebetween and situated adjacent to the stationary contact member to surround the same;

a unitary molded insulator situated around the stationary and moving contact members, said insulator including a pair of side walls facing to each other, and a plurality of slots arranged in the opposed side walls to vertically space apart from each other so that the grids are inserted into the slots and vertically piled together; and auxiliary side walls installed in a space between the side walls of the insulator so that the space inside the insulator is adjusted.

11. A circuit breaker as claimed in claim 10, wherein said auxiliary side walls are disposed above the stationary contact member and adjacent to the grids.

* * * * *